United States Patent [19]

Fullalove

[11] 4,370,226

[45] Jan. 25, 1983

[54] SIFTING MACHINE

[75] Inventor: Richard Fullalove, Denton, England

[73] Assignee: Henry Simon Limited, Cheshire, England

[21] Appl. No.: 238,100

[22] Filed: Feb. 25, 1981

[30] Foreign Application Priority Data

Mar. 12, 1980 [GB] United Kingdom ..... 8008360

[51] Int. Cl.[3] ..... B07B 1/38

[52] U.S. Cl. ..... 209/332; 209/366.5

[58] Field of Search ..... 209/415, 367, 366.5, 209/237, 311, 315, 332

[56] References Cited

U.S. PATENT DOCUMENTS 3,032,200 5/1962 Miller ..... 209/332 X 3,981,403 9/1976 Zimmerman et al. ..... 209/415 X

FOREIGN PATENT DOCUMENTS 357545 8/1922 Fed. Rep. of Germany ..... 209/319

*Primary Examiner*—Ralph J. Hill

*Attorney, Agent, or Firm*—LeBlanc, Nolan, Shur & Nies

[57] ABSTRACT

A sifting machine comprising a sieve box (11) mounted on a framework (10), free-swinging on a plurality of suspension canes (12), the framework (10) carrying a motor (13) which drives via belts (16) and pulleys (15, 17), a pair of vertical shafts (18), each carrying a throwing weight system (19, 20, 21) the shafts and their throwing weight systems being mounted outside the bounds of the sieve box (11), and having their mass distributed evenly above and below a horizontal plane passing through the center of gravity of the sieve box (11).

1 Claim, 2 Drawing Figures

SIFTING MACHINE

This invention concerns sifting machines used for sifting, cleaning or grading various comminuated or ground materials.

Machines of this kind usually comprise one or more stacks of superimposed sifting elements enclosed within a casing which forms a sieve box, and the box is supported for a sifting motion in a generally horizontal plane, usually by reeds or other flexible members attached to the ceiling so that the sieve box is freely suspended therefrom.

A motor is provided to impart the sifting motion to the sieve box, and in some cases the motor is attached to a rigid frame member and connected to the sieve box by a cranked arrangement so that the box is positively driven. Alternatively, the motor may be attached to the suspended sieve box and coupled to a system of weights which are driven in rotation by the motor to set up the necessary gyratory or oscillatory motion required for sifting. This latter kind of machine is generally known in the art as a free-swinging sifter.

The arrangement of the free-swinging system requires that the weights providing the throw of the machine, shall be evenly distributed about the centre of gravity of the swinging mass, and so it is usual for the sieve box to be made up of a plurality of stacks of sifting members arranged in a group with a central open area in which the weights, and usually the motor, may be housed so that the weights act substantially on the centre of gravity of the box.

The free-swinging system as opposed to the cranked system provides certain advantages such as easy adjustment of the weight system to vary the motion as required. An object of this invention is to provide a sifting machine employing the free-swinging principle on a machine having a single stack of sifting members where no central location exists for the weight system. The invention can also be applied to a sifting machine wherein the sieve box comprises a plurality of stacks.

According to the present invention there is provided a sifting machine comprising a freely suspended sieve box, a motor attached thereto and drivingly connected to at least one rotatable shaft also attached to the sieve box and carrying a throwing weight to impart a sifting motion thereto, said throwing weight being located outside the bounds of the sieve box, and its effective mass being distributed evenly above and below a horizontal plane passing through the centre of gravity of the sieve box.

Figure 1:
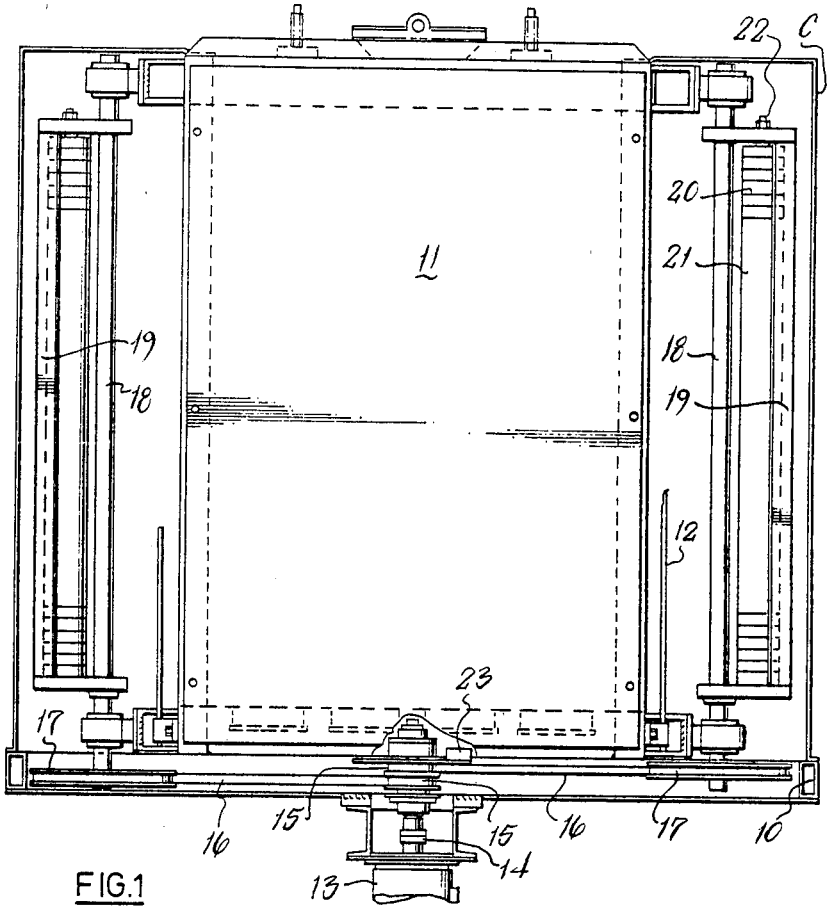
Figure 2:
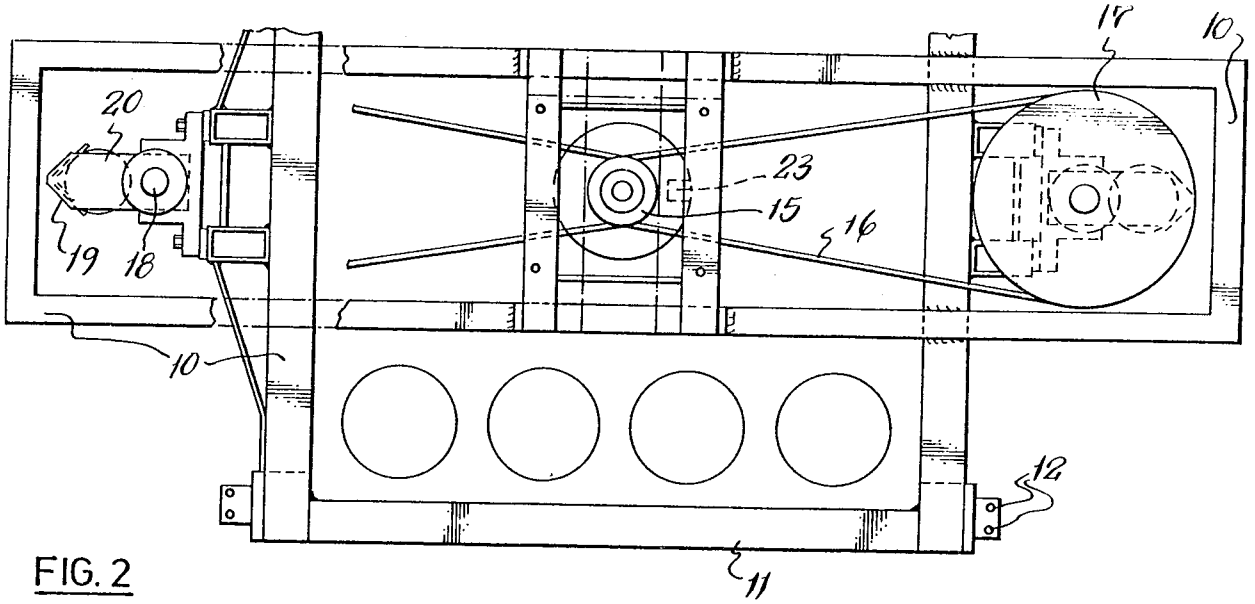

An embodiment of the invention will now be described, by way of example only, with reference to the accompanying drawings in which:

FIG. 1 is a generally elevational view of a sifting machine embodying the invention; and FIG. 2 is a plan view of part of the machine.

Referring now to the drawings, it will be seen that the embodiment described refers to a single stack sifter. The sifter comprises a framework 10 housing a casing 11 enclosing a stack of sifting members of known construction. The framework and casing are suspended from a fixed member above the machine, by way of a plurality of reeds or canes 12 clamped to the framework in the usual way. The construction and functional features of the sifting stack do not form any part of this invention and are not referred to specifically.

Mounted centrally on the framework 10 below its base is an electric motor 13 which via a flexible coupling 14 drives a pair of co-axial toothed belt pulleys 15. Belts 16 wrapping pulleys 15 also wrap toothed belt pulleys 17 of a larger diameter than the pulleys 15 and having axes of rotation outside of the bounds of the casing 11 one on each of two opposite sides thereof. Pulleys 17 are keyed or otherwise attached to a pair of vertical shafts 18 each carrying, for rotation therewith about its axis, a carrier 19 on which may be supported a column of weights 20 and wooden spacers 21. The weights 20 and spacers 21 are held in a fixed position on the carrier 20 by a clamping screw 22. The arrangement and disposition of the weights and spacers is such that the overall mass thereof is distributed evenly above and below a horizontal plane passing through the centre of gravity of the sieve box. A clutch or similar known arrangement may be provided to enable drive to one of the shafts 18 to be disengaged.

In use, if both pulleys 17 are driven simultaneously in the same direction with the sets of weights 20 in phase, one with the other, then a circular motion will be imparted to the suspended mass. For convenience, in the drawings, the sets of weights are shown out of phase with each other. If the drive to one of the shafts 18 is disengaged, then with one set of weights driven and the other free, the free set will rotate at the same speed as the driven set but in the opposite direction, thus providing a linear oscillation transverse to a line between the shafts 18.

If both shafts 18 are driven at the same speed but in such a way that they are not constrained one with the other, for example by two separate motors, then the two sets of weights assume rotation at the same speed and in the same direction, but 180° out of phase. This provides an arcuate swinging movement of the whole mass about a vertical centre line.

The provision of a small weight 23 close to the shaft of the motor 13 applies to the swinging mass a small circular motion which is superimposed upon any motion provided by the weights 20. Thus, in the case where both sets of weights are driven by a single motor so that the weights are constrained to rotate in phase, the overall effect of the weights 20 and the weight 23 would be a generally circular motion upon which a smaller circular motion is superimposed whose centre follows the circumference of the circular path provided by the weights 20. This smaller motion is at motor speed which is considerably greater than the speed of rotation of the weights 20.

It will be appreciated that an arrangement provided as described enables a single stack sifter to be produced and operated using the free-swinging principle, wherein the number and overall mass of the throwing weights can be adjusted as required and wherein the machine as a whole is compact both in its occupation of floor space and height above the floor. Clearly, a plurality of stacks of sifting elements can be connected together in a group where the overall floor space for the same sifting area is reduced when compared with a free-swinging machine whose weights and drive system are located centrally within the sieve box.

The parts of the apparatus including the weights 20 and shafts 18, are preferably enclosed within a casing member C for aesthetic reasons and for safety.

What is claimed is:

1. A sifting machine comprising a freely suspended sieve box, a motor attached thereto and drivingly connected to at least one rotatable shaft also attached to the sieve box and carrying a throwing weight to impart a sifting motion thereto, said throwing weight being located outside the bounds of the sieve box with the effective mass of said throwing weight being distributed evenly above and below a horizontal plane passing through the centre of gravity of the sieve box, and with an additional throwing weight being mounted for rotation about the central vertical axis of said sieve box.

* * * * *